United States Patent [19]

Lowthian

[11] 4,384,381

[45] May 24, 1983

[54] SHEET ASSEMBLIES

[76] Inventor: Peter T. Lowthian, 5 Mullion Close, Stopsley, Luton, Bedfordshire LU2 7XF, England

[21] Appl. No.: 162,790

[22] Filed: Jun. 25, 1980

[30] Foreign Application Priority Data

Jun. 28, 1979 [GB] United Kingdom ..... 7922498

[51] Int. Cl.[3] ..... A47G 9/04

[52] U.S. Cl. ..... 5/496; 5/500

[58] Field of Search ..... 5/484–487, 5/495, 496, 498, 499, 500, 502, 482; D6/258, 260, 267

[56] References Cited

U.S. PATENT DOCUMENTS

| | | | |
|---|---|---|---|
| D. 38,390 | 12/1906 | Christmann | D6/258 |
| 3,011,182 | 12/1961 | Burks | 5/496 |
| 3,394,416 | 7/1968 | Hale . | |
| 3,504,387 | 4/1970 | Hummel . | |

FOREIGN PATENT DOCUMENTS

| | | | |
|---|---|---|---|
| 749921 | 9/1933 | France . | |
| 275440 | 8/1927 | United Kingdom . | |
| 1012503 | 12/1965 | United Kingdom | 5/500 |
| 2023418A | 1/1980 | United Kingdom . | |

*Primary Examiner*—Alexander Grosz

*Attorney, Agent, or Firm*—Cushman, Darby & Cushman

[57] ABSTRACT

A novel sheet assembly for use where frequent bed changing is necessary comprises three sheet members positioned adjacent one another transversely across a mattress. Each sheet member has a main portion for the patient to lie on, and an underlie portion which for two of the members underlies the next adjacent sheet member. The underlie portion of the third sheet member is tucked around the head of the bed. Each sheet member has inclined, laterally extending side flaps tucked under the mattress. Each main portion has a foam core and is thicker than the underlie portion. The assembly allows each bed changing by replacing say one soiled sheet member only. The side flaps retain the sheet members in position during movement of an occupant of the bed.

11 Claims, 8 Drawing Figures

SHEET ASSEMBLIES

The present invention relates to mattresses and sheeting therefor, and is concerned in particular but not exclusively with a sheet assembly for a mattress and a method of using such a sheet assembly, for use with patients in hospital beds.

In present known practice, it is found that a large proportion of hospital mattresses are still protected by a waterproof mattress cover, a bottom (cotton) sheet, a draw-mackintosh (usually a plastic sheet) and a cotton twill drawsheet as the uppermost layer. The waterproof draw-mackintosh (referred to as a draw-mack) and the upper cotton sheet (referred to as the drawsheet) are ordinarily positioned over the central portion of the mattress and are tucked under the long edges of the mattress at each side.

Drawsheets and draw-macks continue to be used on new types of mattresses and special support systems, despite manufacturers' recommendations against using them. This practice has been particularly noticeable on ripple mattresses and on water beds. It seems clear that the drawsheet/draw-mack/bottom sheet system is undesirable from the patient comfort aspect, but the system has persisted for a number of reasons which may be summarised as follows:

(1) the system is convenient for speed of changing when used for incontinent patients;

(2) use of the method minimises the disturbance of very ill patients when their bed linen has to be changed, due to incontinence, wound discharge, bleeding, and so on;

(3) long stay bed-fast patients who take their meals in bed often stain their bottom sheet, and it is found easier if the nurses merely have a drawsheet to change rather than a full bottom sheet; and (4) drawsheets are relatively cheap and have a long laundry life (about 200 washes).

It is one object of the present invention, at least in preferred embodiments thereof, to provide a system of mattress covering which will maintain substantially all of the features of the current drawsheet/draw-mack/-bottom sheet system set out above, but with improved standards of comfort for the patient.

In accordance with the present invention there is provided a sheet assembly for a mattress comprising at least two sheet members adapted for positioning adjacent one another transversely across a mattress to provide a covering for the mattress, at least one sheet member having a portion adapted to underlie part of the other, or another, sheet member when the sheet members are positioned across a mattress.

Where reference is made to a sheet member being positioned across a mattress, it is meant that the sheet member may extend completely across the mattress from side to side thereof, or substantially completely across the mattress, or completely across the mattress and may extend beyond the width of the mattress.

Preferably the number of sheet members in the sheet assembly is three, most preferably the sheet members being of the same size and shape as each other. Preferably at least one sheet member includes side flaps extending laterally for tucking under the sides of a mattress to secure the sheet member on the mattress. It is particularly preferred that the said at least one sheet member includes on each side of the sheet member at least one flap which, when laid coplanar with the remainder of the sheet member, extends laterally at an angle of inclination to the side of the sheet member. Preferably a portion of this flap extends beyond an end of the sheet member at which the said underlie portion is situated.

Preferably at least one sheet member comprises a main portion adapted to provide a contact surface for an occupant of a bed on which the sheet assembly is used and the said underlie portion for underlying part of the or another sheet member, the said underlie portion having a thickness less than the main portion of the sheet member. Preferably the main portion of the sheet member comprises an upper covering layer, providing the said contact surface, a layer of synthetic plastics foam or other washable, cushioning material, and a bottom layer of backing material. Most preferably at least the upper covering layer of the said main portion is formed of smooth but absorbent material (such as toweling material) which is attached by quilting stitch, or bonded, to the foam layer which may also in turn be bonded to the backing material.

Alternatively, in place of the composite structure described, the sheet member may be formed by a natural or synthetic fleece, the said underlie portion being produced for example by shaving off or otherwise removing the upper part of the fleece to leave the backing part of the fleece.

There is also provided in accordance with the invention a mattress assembly comprising a mattress and at least two sheet members positioned adjacent one another transversely across the mattress to provide a covering for the mattress, at least one sheet member being removable for changing purposes while the mattress is occupied and while the other sheet member or members remain on the mattress.

Preferably the number of sheet members in the mattress assembly is three, most preferably the sheet members being of the same size and shape as each other. Preferably at least one sheet member has a portion underlying a part of the other or another sheet member.

Where the number of sheet members in the mattress assembly is three, it is preferred that the middle sheet member has a portion underlying a part of one end sheet member, and the other end sheet member has a portion underlying a part of the middle sheet member. It is further preferred that in such an arrangement the first said end sheet member has a portion corresponding to the underlie portions of the other two sheet members, but that the said corresponding portion on the first end sheet member is tucked under the end of the mattress at which the said end sheet member is positioned. It is preferred that the said three sheet members shall be of the same size and shape, so that, in the preferred arrangement set out above, the first said end sheet member covers a smaller part of the length of the mattress than the other two sheet members. This is advantageous as it allows, in preferred arrangements, for the regions of junction between the sheet members to be positioned away from the heavy and/or protruding parts of the body of a patient using a mattress upon which the sheet members are positioned.

There is further provided in accordance with the present invention a sheet member for combination with one or more other sheet members to form a sheet assembly for a mattress, the sheet member having dimensions adapted for the sheet member to be positioned transversely across a mattress and to provide a covering for part of the length of the mattress, and the sheet member comprising a main portion adapted to provide a surface for an occupant of the mattress, and an underlie portion adapted to underlie part of another sheet member when positioned across a mattress. Such a sheet member may include alone or in combination any of the various features of sheet members set out hereinbefore with respect to the sheet assembly and mattress assembly of the present invention.

If in some practical circumstances it is found desirable for a single such sheet member to be used on a bed without other sheet members of the form set out, then the underlie portion can conveniently be tucked backwards under the main portion of the sheet member.

Where there is provided in accordance with the present invention a sheet member comprising a main portion, an underlie portion, and side flaps, as set out hereinbefore, it is preferred that the side flaps extend outwardly from the said underlie portion of the sheet member, for the purpose, where convenient, of tucking under the mattress to secure the sheet member in place. Where, as has been mentioned, an end sheet member has its underlie portion tucked under a mattress, the side flaps extending from that underlie portion are conveniently tucked around the mattress and back underneath the main portion of that sheet member so as to be sandwiched between an upper surface of the mattress and an upper part of the said main portion. Preferably the said side flaps are made of high-friction material, and may also be made of the same material referred to with regard to the underlie portion. Alternatively, buttons or similar fastenings may be provided for securing the sheet members either directly to the mattress or to an adjacent sheet member.

There is yet further provided in accordance with the present invention a method of making a bed comprising the steps of positioning across a mattress two or more sheet members positioned adjacent one another along the length of the mattress and extending transversely across the mattress to provide a covering for the mattress, and arranging at least one sheet member with a portion thereof of underlying part of an adjacent sheet member. Preferably the method includes the step of tucking under the mattress side, or similarly securing, flaps extending from at least one of the sheet members, preferably from the said underlie portion thereof, for the purpose of securing the sheet member on the mattress. Preferably the number of sheet members positioned across the mattress is three.

There is still further provided in accordance with the present invention a method of changing a bed comprising the steps of moving to one side of a mattress a patient occupying a bed, rolling towards the patient a soiled sheet member which together with one or more other sheet members is positioned transversely across the mattress to provide a covering for the mattress, partially unrolling onto the mattress a fresh sheet member to take the place of the partially rolled soiled sheet member, moving the patient over the partially rolled sheet members to the other side of the mattress, removing the soiled sheet member, and unrolling the reminder of the fresh sheet member to take the place of the soiled sheet member.

Embodiments of the invention will now be described by way of example with reference to the accompanying drawings in which:

FIG. 1(*a*) is a perspective view (not to scale) of a modification of part of the sheet member shown in FIG. 1;

Referring firstly to FIGS. 1 to 4, there will be described a sheet assembly suitable for the majority of adult hospital beds, including contouring beds, water beds and so-called "Net" suspension beds. In most cases the assembly is also usable on domestic (single) beds, so-called ripple mattresses and ventilated mattresses. However, with reference to the drawings, the assembly will be described in use on a conventional single-size adult hospital mattress.

Figures 1, 1A:
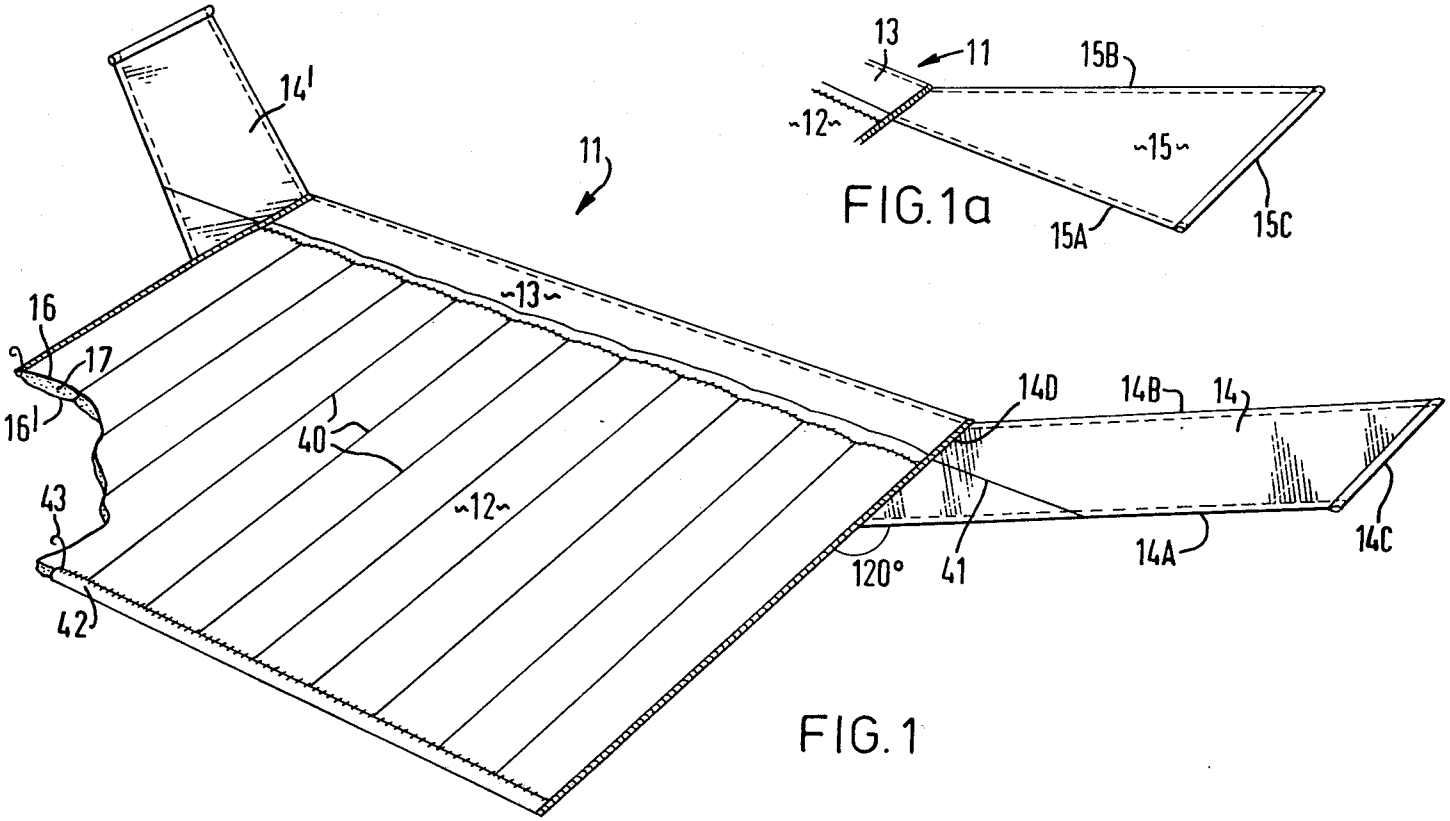
FIG. 1 is a perspective view (not to scale) from above of a sheet member embodying the invention for use in covering a mattress.

In FIG. 1 there is shown in perspective view a single sheet member 11 comprising a main portion 12 and an underlie portion 13 from which extend two side flaps 14 and 14'. In FIG. 1 (which is not to scale) the flaps 14 and 14' are shown extended in the same plane as the plane of the main portion 12 and underlie portion 13. The main portion 12 is formed of upper and lower layers 16 and 16' of stretch towelling secured by a continuous quilting stitch along lines 40 to an inner layer 17 of polyether foam. The underlie portion 13 is conveniently made of conventional cotton sheeting, and is of lesser thickness than the thickness of the main portion 12. The flaps 14 and 14' are made of high friction material for tucking under the mattress to secure the sheet member 11.

Figure 3:
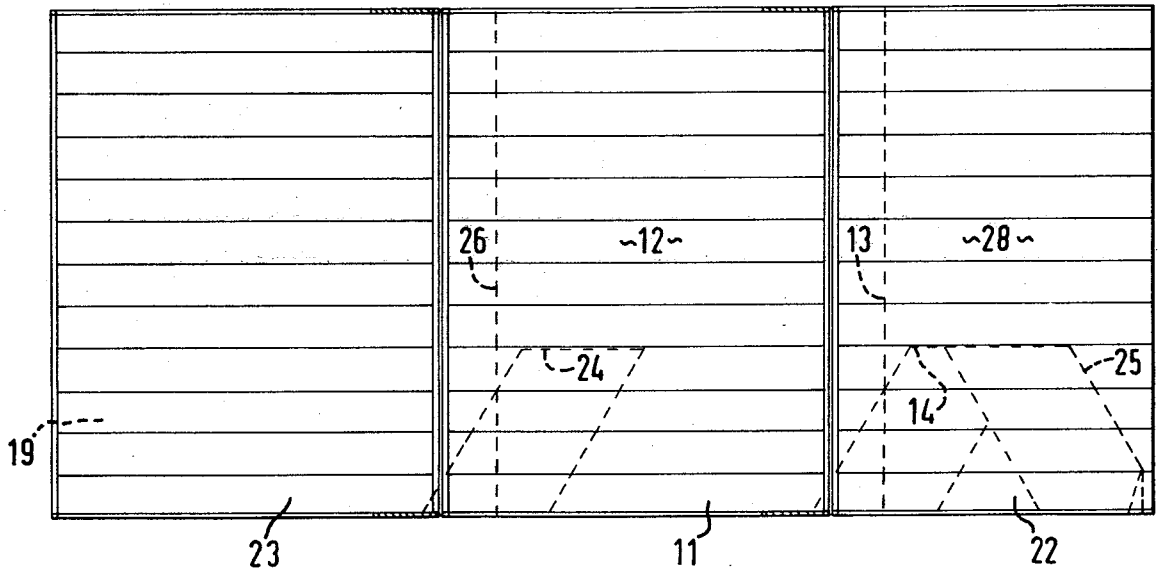
FIGS. 2 and 3 are side and plan views of a mattress assembly embodying the invention in which three sheet members as shown in FIG. 1 are positioned on a mattress.
Figure 2:
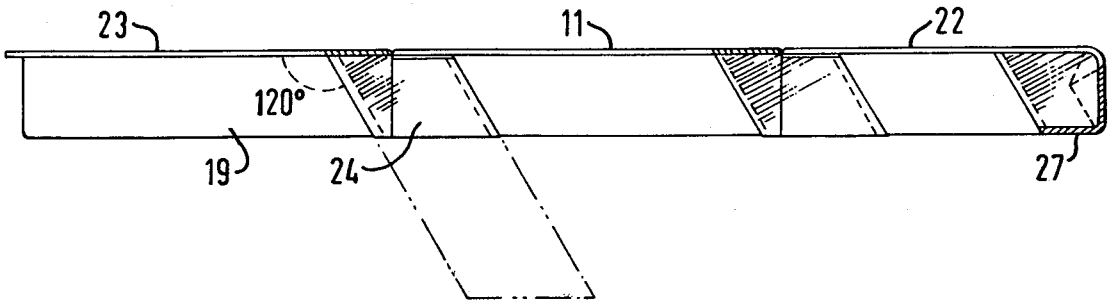
Figure 4:
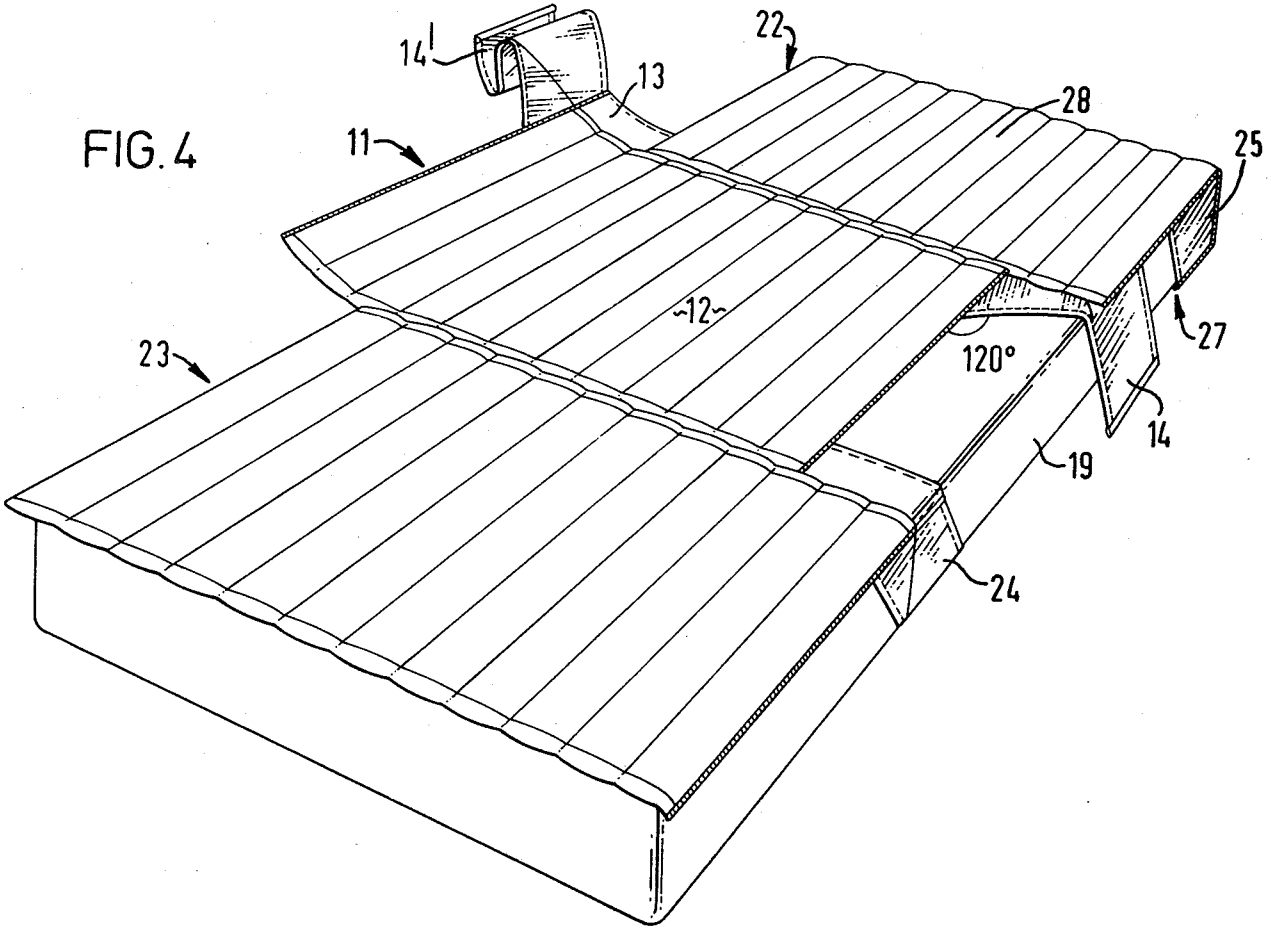
FIG. 4 is a perspective view (not to scale) from above of the mattress assembly shown in FIGS. 2 and 3, but with one sheet member partially removed.

Referring to FIGS. 2, 3 and 4 in addition to FIG. 1, a mattress 12 is covered by three sheet members 11, 22 and 23, of which the sheet member 11 has been shown in FIG. 1. The sheet members 22 and 23 are of identical construction to the sheet member 11. The sheet member 22 is positioned at the head of the bed (relative to the intended position of the occupant of the bed) and the sheet member 23 is positioned at the front of the bed.

The three sheet members 11, 22 and 23 are positioned across the mattress adjacent to one another with an underlie portion 26 of sheet member 23 underlying part of the sheet member 11, and the underlie portion 13 of the sheet member 11 underlying part of the sheet member 22. As shown in FIGS. 2 and 3, the side flap 14 of the sheet member 11 is tucked under the mattress 19, as is the side flap 14' (not shown). The side flaps of the sheet member 23 (of which one is indicated at 24) are tucked in similar fashion under the mattress 19.

The folding of the head sheet member 22 is arranged differently from the sheet members 11 and 23. One side flap of the sheet member 22 is indicated at 25 (the other not being visible in the drawings) and the underlie portion of the sheet member 22 is indicated at 27. For the end sheet member 22, the underlie portion 27 is not arranged to underlie another sheet member, but instead is tucked under the mattress 19 along the short, head side of the mattress. As is shown in FIGS. 2 and 3, the side flap 25 extending from the underlie portion 27 of the head end sheet is then folded back upwardly along the long side of the mattress 19 and is tucked under the main portion of the sheet member 22 (the main portion being indicated at 28). As shown particularly in FIG. 1, there may be provided an indelible line 41 marked on each of the flaps 14, 14' and so on, to assist in the folding of the flaps. This line 41 is used to position the head sheet member 22 to allow easy folding of the flap 25 under the main portion 28.

FIG. 4 shows the mattress assembly with one sheet member 11 pulled slightly to one side, to illustrate for purposes of explanation the interrelationships between the various sheet elements.

As has been mentioned, the main portion of the sheet member 11 shown in FIG. 1 is formed of a core 17 of synthetic plastics foam material. This gives the effect of the sheet member 11 (and also the other members 22 and 23) forming a pad, and in the next following description, the sheet members will be referred to as pads.

In use the three pads 11, 22 and 23 are laid directly onto the waterproof cover of the mattress 19. Preferably the mattress cover has a water vapour permeability of about 1,000 to 2,000 g/m$^2$/day of 40° C. by the so-called Payne's cup test method. The waterproof cover is the only waterproof part of the mattress. By way of example, the appropriate materials for such a cover are described in the U.K. Pat. No. 1,341,325 at line 110 on page 2 to line 35 on page 3 and in U.K. Pat. No. 1,443,759 at lines 6 to 22 on page 3. Conveniently the central pad 11 is changed (when soiled) as follows:

(a) A clean pad (not shown) is obtained and rolled up by one of the two nurses performing the task. The rolling starts from one of the flap sides of the pad and the other flap is left free.

(b) The patient is rolled on his side to the edge of his mattress and cleaned (if necessary).

(c) The soiled pad 11 is rolled up under the patient (starting with the free flap 14 and including the underlie extension 13) as it is pulled from under the head pad 22.

(d) The cover surface of the mattress 19 is wiped clean (if necessary).

(e) The new pad (not shown) is placed in position, the free flap is tucked under the mattress, and the pad is unrolled until it meets the partially rolled soiled pad 11.

(f) The overlap extension of the new pad is eased under the head pad 22 as far as it will go.

(g) The patient is now rolled back to the opposite side of the mattress 19 and the second nurse pulls free the soiled pad, cleans the mattress cover and unrolls the clean pad. She also tucks the remaining part of the underlie extension under the head pad 22 and tucks the unrolled flap under the mattress 19.

The above procedure is similar to the typical draw-sheet changing procedure but is easier to accomplish.

Referring again to the arrangement of FIGS. 1, 2 and 3, the flaps 24, 24', 14, 14', 25 and 25' of the pads 23, 11 and 22 are arranged so as to avoid tensioning the mattress surface where the heavy and/or prominent parts of the body are normally positioned. This reduces pressure levels on the bony prominences which are most likely to be the site of pressure sores (ie the sacrum, hips and heels). Being positioned at the head end of each pad, the flaps are also able to anchor the central and foot pads 11 and 23 more effectively against the considerable shearing forces which develop when patients sit up in bed. It is a particular feature of the embodiment described so far, that the side flaps project from the main portion of the sheet member at an angle other than 90°. Referring for example to the sheet member 11 in FIG. 1, the flap 14 projects from the main portion 12 and underlie portion 13 in such a way that the longer side of the flap 14 facing towards the foot of the bed (indicated at 14A) makes an angle of 120° with the side edge of the main portion 12. Thus the flap 14 projects not only outwardly relative to the main portion 12 but also longitudinally towards the head of the bed. In other embodiments this angle between the side 14A of the flap 14 and the side of the main portion 12 may be other than 120°, and may be preferably in the range 100° to 140°, most preferably in the range 110° to 130°. In FIG. 1(*a*) there is shown a modification of the flaps 14 and 14' shown in FIG. 1. The modified flap is shown at 15 and has a side 15B at the head end of the flap 15, a side 15A positioned at the foot end of the flap 15, and a rolled side edge 15C. As shown in FIG. 1(*a*) the flap 15 is substantially triangular in shape, the foot end side 15A making an angle of 90° with the side of the main portion 12, and the head end side 15B making an angle of between 110° to 140° with the side of the main portion 12. In this case the foot end side 15A of the flap 15 is positioned in line with the edge of the main pad portion 12 and the extreme edge 15C of the flap 15 is longer than that shown in FIG. 1.

Preferably each of the side flaps (eg 14) terminates in a rolled edge (eg 14C) to assist anchoring of the flap. In some embodiments the width of the flap 14 may be such that the end edge indicated at 14D is the same length as the shorter side of the underlying portion 13, or the end edge 14D may be longer as shown in FIG. 1 so as to be secured partly to the underlie portion 13 and partly to the main portion 12.

When the sheet members are used in a so-called "net" suspension bed, the flaps are simply tucked under the pads.

By way of example of dimensions which may be used, the main portion 12 of a sheet member may have dimensions of 990 mm by 740 mm. The underlie portion may be made of material 132 mm wide, including 17 mm for stitching to the main portion 12, and 5 mm for the hemmed edge. The side flaps 14 and 14' are cut at an angle as has been described. The long edges shown at 14A and 14B may be 540 mm, but an extra 30 mm of material is needed for the rolled edge. The short edges shown as 14C of the flaps are 240 mm long, but the actual width of each flap at right angles to its longer edge is 200 mm. In this particular embodiment, if a wider flap material is used (e.g. 250 mm) this should be attached to an underlie portion which is 25 mm wider than the suggested measurement above (ie 157 mm). As shown in FIG. 1, the excess width of the flap 14 beyond the underlie portion is sewn to the side of the main portion 12. The extreme end of each flap may be finished as shown in FIG. 1, with the end cut at 60° to the longer edge of the flap indicated at 14B, or it may be cut at right angles to the long edge 14B. In the latter case, the long edge 14B of the flap is 420 mm and the other long edge 14A remains at 540 mm. The rolled edge of each flap is preferably not more than 6 mm in diameter (uncompressed).

In the preferred version of the pad shown, there are eleven lines 40 of quilting stitch running along the pad, and these should be equally spaced. Self binding strips 42 as shown in FIG. 1 can be used for the pad edges and are conveniently 25 mm wide. The overall thickness of the main portion of the pad should preferably be 10 mm plus or minus 2 1 mm. The underlie portion of each pad should be as thin as possible consistent with the required strength.

By way of example of the materials which may be used, the foam core of each pad may be a fire-retardant grade of open-cell flexible polyether foam having a density of about 33 $Kg/m^3$ and a low compression set, that is to say a good fatigue resistance. The foam should be fairly resilient but not so resilient that it fails to stay in a loose roll, as is required when the pads are being changed. However this may be less important if the foam gradually loses resilience upon laundering.

The foam should be such as to withstand repeated hospital laundering without serious loss of hardness/-resilience. Ideally, it should be able to stand 200 launderings, the pads being washed in the same way as towels.

The uppermost surface of the pad should have a relatively low friction (preferably slightly lower than the friction of standard hospital sheets), and should contain sufficient cotton/viscose material to absorb fluid excreta. Its absorptive capacity should be similar to that of a good towel. It should also be a weft-knitted fabric which is pre-shrunk and able to withstand repeated laundering as mentioned above. Thus it is preferred that the pads shown in the drawings have their main portions 12 surfaced by knitted towelling. Any adhesive used for bonding the surfacing material to the foam (as will be described below in an alternative method of construction) must be porous.

The backing of each main portion is made from the same material as the uppermost surface so that any shrinkage due to laundering will not result in the pad curling or bowing.

If the material used for covering the foam core has dissimilar surfaces (as may be the case with towelling) it is best that the smooth surface is used on all the outside surfaces of the pad.

The flaps of each pad should be made from a material which is both strong and has a high coefficient of friction, when matched with the various mattress cover materials it is likely to encounter.

The rolled edge of each flap may contain a thin strip of polyether foam, to give improved anchorage under the mattress. The material of the flaps should also by hygroscopic, although a synthetic material which is unlikely to cause high static electric charges (when used in conjunction with polyurethane or nylon mattress covers) would be acceptable.

The underlie portion of each sheet member should be a smooth woven material which is also absorbent, ordinary cotton sheeting being preferred.

In the preferred form shown in FIGS. 1 to 4, each pad is constructed by stitching the foam core to the uppermost layer and the backing with a continuous quilting stitch. This longitudinal quilting (down the bed) holds the foam core in place, without bonding being needed, and also makes it easy for the nurses to align the pads correctly when they are positioning them on a bed.

In an alternative construction (not shown in the figures) the uppermost layer and backing material are bonded to the two sides of the foam core with a porous adhesive. Both constructions can be produced by a continuous process with the foam roll and the two material rolls all being 990 mm wide.

On the quilted type of construction, the surfacing material should be aligned so that the quilting stitch is aligned with the weft of the material, so as to avoid excessive stretching of the fabric between the lines of quilting due to shear forces when patients are seated in bed.

Once the continuous laminate has been produced by either method, it is cut into 740 mm wide pads, and the cut edges are bound using self-binding edging 42, and stitching 43. The binding 42 is the same material as the pad surfacing material, as this ensures that there is no sudden change in friction characteristics of the uppermost surface of the pads. Alternatively, all edges of the pad are secured with an "overlock" stitch.

Any stitching showing on the pad surface should be minimal. The hemmed edge of the underlie portion is kept as shallow as possible.

The high friction side flaps are prepared separately. The flaps may be stitched to the sides of the pad at the same time that the pad sides are finished, suitably using a safety overlock stitch. The indelible line 41 previously mentioned is marked to line up with the edge of the main portion 12 where it joins the underlie portion 13 (in the example shown in FIG. 1) and as an alternative this line may be replaced by a coloured stitch line on the flaps. If the flaps are triangular, as described hereinbefore, no indelible folding line is required.

The foam core of the pads eliminates the need for ironing the sheet members of the assembly, and also resists creasing and crumpling due to side forces, as the patient moves about on his mattress.

There will now be described with reference to FIGS. 3 to 7 an alternative embodiment of the invention. In general, corresponding elements shown in the embodiments of FIGS. 1 to 4, and FIGS. 5 to 7, are indicated by like reference numerals.

Figure 5:
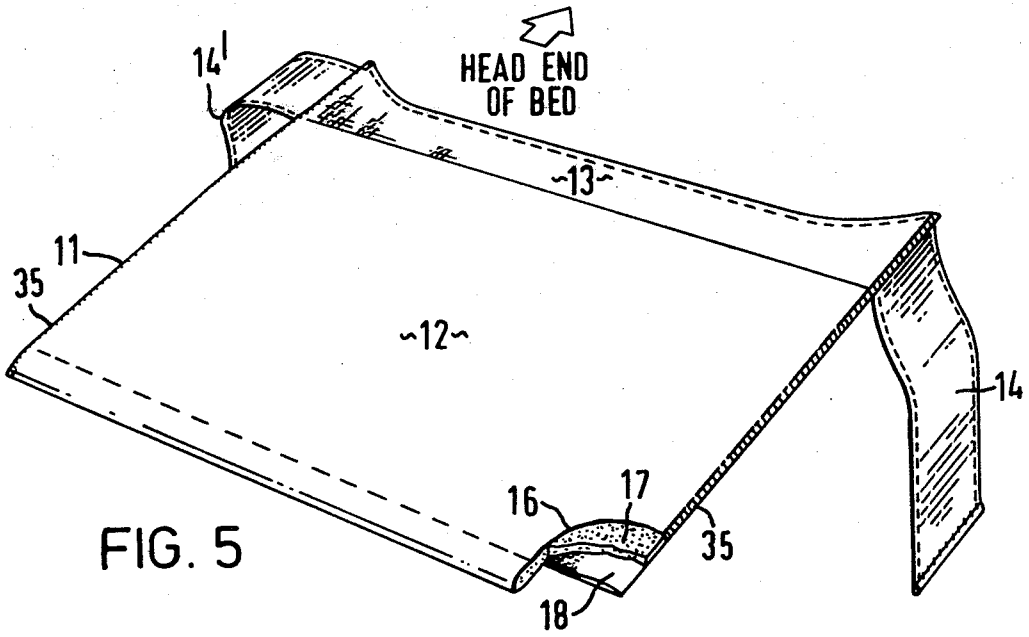
FIG. 5 is a perspective view (not to scale) from above of a second embodiment of a sheet member embodying the invention.

In FIG. 5 there is shown in perspective view a single sheet member 11 and the main portion 12 is formed of an upper layer 16 of stretch towelling bonded to an inner layer 17 of polyether foam which in turn is covered by a layer 18 of backing material. The backing material 18 continues to form the underlie portion 13 which is thus of lesser thickness than the thickness of main portion 12. The flaps 14 and 14' are made of high friction material for tucking under the mattress to secure the sheet member 11. As has been described with the embodiment of FIGS. 1 to 4, a mattress 19 is covered by three sheet members 11, 22 and 23, the sheet members 22 and 23 being of identical construction to the sheet member 11. The sheet member 22 is positioned at the head of the bed (relative to the position of an occupant of the bed, shown by way of example at 20 in FIG. 6), and the sheet member 23 is positioned at the foot of the bed.

Figure 6:
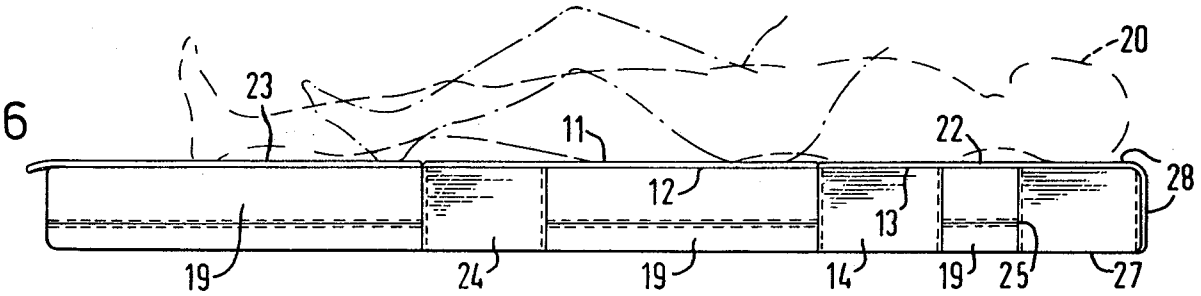

The three sheet members 11, 22 and 23 are positioned across the mattress adjacent to one another with the underlie portion 26 of sheet member 23 underlying part of the sheet member 11 and the underlie portion of the sheet member 11 underlying part of the sheet member 22. As shown in FIG. 6, the side flap 14 of the sheet member 11 is tucked under the mattress 19 as is the side flap 14' (not shown). The side flaps of the sheet member 23 (of which one is indicated at 24) are tucked in similar fashion under the mattress 19.

The folding of the head sheet member 22 is arranged differently from the sheet members 11 and 23. The side flaps of the sheet member 22 are indicated at 25 and 25' and the underlie portion is indicated at 27. In fact for the end sheet member the underlie portion is not arranged to underlie another sheet member, but instead is tucked under the mattress along the short, head side of the mattress. The side flaps 25 and 25' extending from the underlie portion 27 are then folded back upwardly along the sides of the mattress 19 and are tucked under the main portion of the sheet member 22 (the main portion being indicated at 28).

Figure 7:
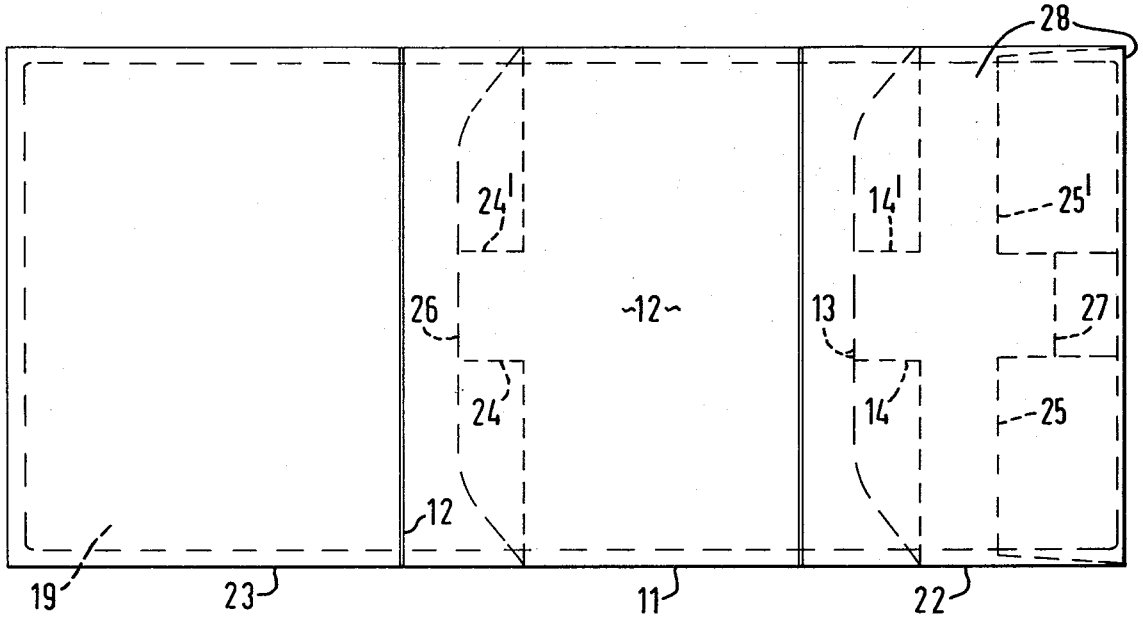
FIGS. 6 and 7 are side and plan views respectively of a second embodiment of a mattress assembly in which three sheet members as shown in FIG. 5 are positioned on a mattress.

One of the main differences between the embodiment of FIGS. 5 to 7 and the previous embodiment, is that the flaps eg 14 and 14', extend laterally at right angles to the sides of the remainder of the sheet member and the edges of the underlie portion are angled. However, because the flaps are positioned at the head end of each pad, the flaps are still able to anchor the central and foot pads 11 and 23 more effectively against the considerable shearing forces which develop when patients sit up in bed. Construction details of this embodiment differ from the preferred embodiment in that the backing material 18 is not bonded to the main pad 12 but is stitched to the uppermost layer of towelling 16 where this is extended around the main pad 12 at the head end and foot end edges. Such a construction avoids stitching on the main pad (uppermost) surface, but does not facilitate commercial production of the sheet member.

In order to comply with safety requirements, the following features should preferably be present. The materials used should have a low flammability, especially the surface towelling material. All materials used should be Hypo-allergenic and non-toxic. No coloured fabrics should be used, unless these are pastel shades which will withstand bleaching. The pads should be capable of disinfection by an approved method. These safety requirements apply to both embodiments described with reference to the drawings.

I claim:

1. A mattress assembly comprising:

a mattress;

a first sheet member positioned transversely across the mattress at the head of the mattress;

a second sheet member positioned transversely across the mattress at a position intermediate the head and the foot of the mattress; and a third member positioned transversely across the mattress at the foot of the mattress;

said first, second and third sheet members being of substantially identical size, shape and construction, and each sheet member being formed by a member which is a substantial flat planar member when removed from said mattress;

each said sheet member comprising a main portion, and an underlie portion, said underlie portion of each sheet member having a thickness less than the thickness of said main portion thereof;

said first sheet member being positioned with said underlie portion thereof and part of said main portion thereof folded to leave only part of said main portion exposed on top of said mattress;

said second sheet member being positioned with said underlie portion thereof underlying part of said main portion of said first sheet member, and with said main portion of said second sheet member closer to the head of the mattress than to the foot of the mattress; and said third sheet member being positioned with said underlie portion thereof underlying part of said main portion of said second sheet member.

2. An assembly according to claim 1 in which each said sheet member has side flaps extending laterally of said sheet member for tucking around the sides of said mattress to secure said sheet member on said mattress.

3. An assembly according to claim 2 in which each sheet member has on each side thereof a side flap which, when laid coplanar with the remainder of the sheet member, has at least a portion which extends laterally at an angle of inclination to the side of the sheet member.

4. An assembly according to claim 1 in which said main portion of each said sheet member comprises an upper covering layer providing a contact surface for a user of the mattress assembly, a layer of washable cushioning material, and a bottom layer of backing material.

5. A mattress assembly comprising:

a mattress;

a first sheet member positioned transversely across the mattress at the head of the mattress;

a second sheet member positioned transversely across the mattress at a position intermediate the head and the foot of the mattress; and a third sheet member positioned transversely across the mattress at the foot of the mattress;

the first, second and third sheet members being of substantially identical size, shape and construction, and each sheet member being formed by a member which is a substantially flat planar member when removed from the mattress;

each sheet member comprising a main portion, and an underlie portion, and side flaps extending laterally from the sides of the sheet member for retaining the sheet member in position on the mattress, said underlie portion of each sheet member having a thickness less than the thickness of said main portion thereof;

said first sheet member being positioned with said underlie portion thereof and part of said main portion thereof folded around the head of the mattress to leave only part of said main portion exposed on top of said mattress, said underlie portion of said first sheet member being positioned under said mattress, and at least part of each side flap leading upwardly from said folded part of said first sheet member and being tucked between the top of said mattress and said exposed part of said first sheet member which is on top of said mattress;

said second sheet member being positioned with said underlie portion thereof underlying part of said main portion of said first sheet member, and with said main portion of said second sheet member closer to the head of the mattress than to the foot of the mattress, said side flaps of said second sheet member leading downwardly and being tucked under said mattress; and said third sheet member being positioned with said underlie portion thereof underlying part of said main portion of said second sheet member, said side flaps of said third sheet member leading downwardly and being tucked under said mattress.

6. A set of sheet members for forming a sheet assembly for a mattress, said set of sheet members comprising three sheet members of substantially identical size, shape and construction, each sheet member comprising:

a main portion, said main portion being adapted to provide a contact surface for a user of a mattress on which the sheet member is used;

an underlie portion, said underlie portion being of smaller area than said main portion and being adapted for underlying part of another sheet member when in use on a mattress, said underlie portion having a thickness less than the thickness of said main portion; and side flaps extending laterally from the sides of said sheet member for retaining said sheet member in position on a mattress, each side flap having a width dimension, taken in a direction along the side of said sheet member, which is less than the length of the side of said sheet member, each side flap being positioned at or in the region of said underlie portion, and each side flap having a thickness less than the thickness of said main portion of said sheet member;

each sheet member being formed by a member which is a substantially flat planar member when not in use on a mattress, and each sheet member having dimensions adapted for the sheet member to be positioned transversely across a single bed mattress of conventional shape and size to provide a covering for part of the length of the mattress.

7. A sheet member according to claim 6, in which said sheet member has on each side thereof a side flap which, when laid coplanar with the remainder of said sheet member, has at least a portion which extends laterally at an angle of inclination to the side of said sheet member.

8. A sheet member according to claim 6 in which said main portion of said sheet member comprises an upper covering layer providing said contact surface, a layer of washable cushioning material, and a bottom layer of backing material.

9. A method of making a bed comprising the steps of:

positioning transversely across the mattress at the head of the mattress a first sheet member having a main portion and an underlie portion;

folding said underlie portion of said first sheet member and part of said main portion of said first sheet member so as to leave only part of said main portion of said first sheet member exposed on top of said mattress;

positioning transversely across said mattress at a position intermediate the head and foot of the mattress a second sheet member having a main portion and an underlie portion;

arranging said second sheet member with said underlie portion thereof underlying part of said main portion of said first sheet member, and with said main portion of said second sheet member closer to the head of the mattress than to the foot of the mattress;

positioning transversely across said mattress at the foot of the mattress a third sheet member comprising a main portion and an underlie portion; and arranging said third sheet member with said underlie portion thereof underlying part of said main portion of said second sheet member.

10. A method according to claim 9, including the steps of tucking around the sides of said mattress side flaps extending laterally of each said sheet member, so as to retain each said sheet member on said mattress.

11. A method according to claim 10 including the steps of:

folding said underlie portion and part of said main portion of said first sheet member around the head of said mattress so as to position said underlie portion of said first sheet member under said mattress; and lifting part of each side flap of said first sheet member upwardly from said folded part of said first sheet member and tucking said part of said side flap between the top of said mattress and said exposed part of said first sheet member which is on top of said mattress.

* * * * *